US005375387A

United States Patent [19]

Davenport

[11] Patent Number: 5,375,387

[45] Date of Patent: Dec. 27, 1994

[54] ROOFING SHINGLE PROVIDING SIMULATED SLATE ROOF COVERING

[76] Inventor: Ralph G. Davenport, 9200 Frist Haven Dr., Alexandria, Va. 22309

[21] Appl. No.: 817,642

[22] Filed: Jan. 7, 1992

[51] Int. Cl.[5] ..... E04D 1/26

[52] U.S. Cl. ..... 52/557; 52/311.1; 52/551

[58] Field of Search ..... 52/554, 555, 557, 311, 52/314, 312, 558, 559, 551, 311.1

[56] References Cited

U.S. PATENT DOCUMENTS

| | | | |
|---|---|---|---|
| 15,439 | 8/1922 | Ferguson . | |
| D. 251,808 | 5/1979 | Patenaude . | |
| D. 265,510 | 7/1982 | Bedwell, Jr. . | |
| D. 277,411 | 1/1985 | Spinelli et al. . | |
| D. 309,027 | 7/1990 | Noone et al. . | |
| 1,310,082 | 7/1919 | Hose . | |
| 1,612,776 | 12/1926 | Kirschbraun . | |
| 1,627,665 | 5/1927 | Overbury . | |
| 1,650,285 | 11/1927 | Lindley | 52/545 |
| 1,674,630 | 6/1928 | Beckman . | |
| 1,911,014 | 5/1933 | Cowan . | |
| 1,958,560 | 5/1934 | Beckman | 52/557 |
| 1,959,519 | 5/1934 | Black | 52/551 |
| 2,000,030 | 5/1935 | Knapp . | |
| 2,096,968 | 10/1937 | Johnston | 52/558 |
| 2,113,644 | 4/1938 | Bollaert | 52/557 |
| 2,118,250 | 5/1938 | Knapp . | |
| 2,196,847 | 4/1940 | Austin | 52/554 |
| 2,335,493 | 11/1943 | Drinkall | 52/314 |
| 4,333,379 | 6/1982 | Corbin . | |

*Primary Examiner*—James L. Ridgill, Jr.
*Attorney, Agent, or Firm*—Shlesinger, Arkwright & Garvey

[57] ABSTRACT

A generally rectangular roofing element adapted to be positioned with other similar elements in an overlapping relation to yield a simulated slate roof covering comprising a main body portion bordered by a top edge, butt edge, leading edge and trailing edge. The leading and trailing edges extend between the top edge and the butt edge. A headlap portion is provided and is bordered by the top edge. A butt portion is also provided and is bordered by the butt edge. At least a portion of the headlap portion is substantially darker than the butt portion in the area of contact with the butt portion. The darkened portion in the area contact with the butt portion forms a substantially straight line parallel to the butt edge. The butt portion includes a series of laterally adjacent simulated shingles extending from the leading edge to the trailing edge. Each simulated shingle has an edge forming a portion of the overall butt edge. In addition, each simulated shingle is provided with a simulated keyslot extending from the butt edge rearwardly towards the headlap portion and in contact therewith. The simulated keyslot has a coloration similar to the darkened headlap portion and is integral therewith. The simulated keyslots are equal in width and form a parallel series along the butt portion whereby the first of the series of simulated keyslots is spaced inwardly from the leading edge and the last of the simulated keyslots is positioned adjacent to the trailing edge.

7 Claims, 2 Drawing Sheets

ROOFING SHINGLE PROVIDING SIMULATED SLATE ROOF COVERING

FIELD OF THE INVENTION

The present invention relates to a weatherproof roof covering and more particularly, to individual covering elements or shingles each of which are secured to the roof in an overlapping fashion to produce a simulated slate roof covering.

BACKGROUND OF THE INVENTION

The building industry has long used overlapping shingles in residential home construction. More specifically, the shingles are generally made from a flexible sheet of felt which has been saturated or coated with a waterproof substance such as asphalt and then covered with a weather-resistant surface of granular mineral material, such as slate or granulated rock. Such shingles are usually rectangular in shape and combined with other substantially identical shingles in an overlapping relation to thereby provide a protective cover for a sloping roof surface.

A desired characteristic of such shingle elements is that when arranged in the overlapping fashion, the exposed surfaces of the shingle element should simulate a regular pattern typical of a genuine slate covered roof. Thus, in addition to protecting the roof against the weather, the shingle elements also serve an aesthetic function. A homeowner is provided with an attractive roof having the appearance of random edges and shadow lines normally associated with authentic slate shingles but at a fraction of the cost.

The above so-called "strip shingles" generally comprise a butt portion having a generally uninterrupted exposed surface extending from a leading edge to a trailing edge thereof. The butt edge is defined by the lower edge of the butt portion and may include particular aesthetic features such as a jagged surface to simulate the wooden shakes or other repeating geometric patterns to imitate slate, tile, etc.

One example of such a shingle element is shown in U.S. Pat. Des. No. 265,510 (Bedwell, Jr.) which illustrates an asphalt strip roofing shingle provided with an irregular surface extending along the butt edge of the shingle and further including shadow lines extending vertically along the length of the shingle. Thus, when a plurality of such shingles are arranged in an overlapping fashion, the butt edge provides an overall appearance of a slate roof with the vertical shadow lines delineating the appearance of individual shingles.

Another prior art shingle of the type discussed is shown in U.S. Pat. No. 4,333,279 (Corbin et al.) which additionally provides slot cut-outs at spaced uniform intervals across the butt portion and extending vertically substantially fully across the exposed butt portion and upwardly from the butt edge thereof. These slot cut-outs define tabs which, when combined with other such shingles, simulate a regular pattern of, for example, a slate shingle roof.

U.S. Pat. Des. No. 309,027 (Noone et al.) discloses a shingle similar to the above cited Corbin et al. patent but further disclosing various shading embodiments to denote a variety of individual shingles.

U.S. Pat. No. 1,911,014 (Cowan) discloses a siding shingle which includes the slot cut-outs shown in Corbin et al. and further including a headlap portion which is darkened with respect to the butt end portion so that when arranged in an overlap fashion the darkened portions simulate bricks.

Thus, the prior art shingles fail to provide butt edge features which are designed to provide a continuous irregular features regardless the roof length to be covered. These prior art devices, although providing a limited irregular butt edge, fail to provide a roof covering whose overall effect is to give the appearance of a genuine slate shingle roofing. In addition, the prior art fails to provide vertical shadow lines which set-off individual simulated shingles from each other and give a more authentic effect without the need for cut-outs.

OBJECTS AND SUMMARY OF THE INVENTION

It is therefore an object of the present invention to provide a roofing element which, when arranged with other such elements upon a roof and in an overlapping fashion, provides a simulated slate roof covering that is authentic in appearance.

A further object of the present invention is to provide a roofing element which includes shadow lines which are highly off-set from each other thereby providing greater contrast and definition between the individual simulated shingles.

Still a further object of the present invention is to provide a roofing element which includes an irregular butt edge portion so that when arranged with other similar roofing elements the butt edge portion repeats in an apparently random fashion and yields an overall covering that is more natural in appearance.

Still a further object of the present invention is to provide a roofing element provided with a substantially darkened area which when overlapped with other such similar roofing elements depicts authentic horizontal shadow lines along the butt edge portion of the roofing element.

Still a further object of the present invention is to provide a roofing element which can be quickly and easily aligned and positioned relative to other such roofing elements and thereby results in a savings of both cost and time during installation.

These and other objects are achieved by providing a generally rectangular roofing element adapted to be positioned with other similar elements in an overlapping relation to yield a simulated slate roof covering comprising a main body portion bordered by a top edge, butt edge, leading edge and trailing edge. The leading and trailing edges extend between the top edge and the butt edge. A headlap portion is provided and is bordered by the top edge. A butt portion is also provided and is bordered by the butt edge. At least a portion of the headlap portion is substantially darker than the butt portion in the area of contact with the butt portion. The darkened portion in the area contact with the butt portion forms a substantially straight line parallel to the butt edge. The butt portion includes a series of laterally adjacent simulated shingles extending from the leading edge to the trailing edge. Each simulated shingle has an edge forming a portion of the overall butt edge. In addition, each simulated shingle is provided with a simulated keyslot extending from the butt edge rearwardly towards the headlap portion and in contact therewith. The simulated keyslot has a coloration similar to the darkened headlap portion and is integral therewith. The simulated keyslots are equal in width and form a parallel series along the butt portion whereby the first of the series of simulated keyslots is spaced inwardly from the leading edge and the last of the simulated keyslots is positioned adjacent to the trailing edge.

Additional objects, advantages and features of the present invention will become apparent from a consideration of the following specification taken in conjunction with the accompanying drawings.

DETAILED DESCRIPTION OF PREFERRED EMBODIMENTS

Figure 1:
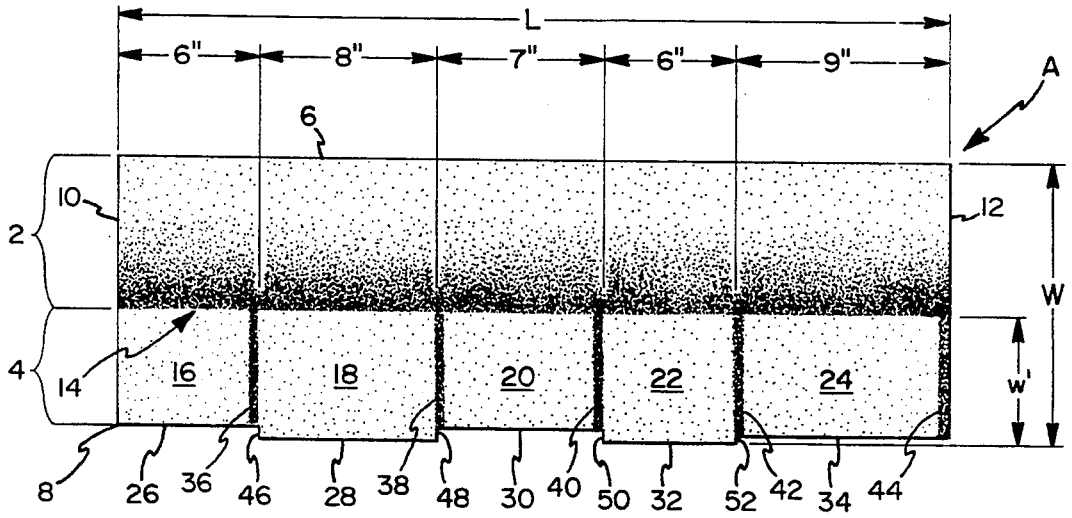
FIG. 1 is a plan view showing a preferred embodiment of a covering element according to the present invention.

Referring now to the drawings and in particular to FIG. 1, a generally rectangular shingle or roofing element A having a generally planar shape is shown. The roofing element A includes a headlap portion 2 and a butt portion 4 extending the entire length L of the roofing element A. The overall rectangular shape of the roofing element A is defined by a top edge 6 which borders the headlap portion 2 and also extends the length L of the roofing element A. A butt edge 8 runs along the lower edge of the butt portion 4, and extends the entire length L of the roofing element A. A leading edge 10 and a trailing edge 12 extend between the top edge 6 and the butt edge 8 and the overall width W of the roofing element A.

The overall dimensions of the roofing element A in the preferred embodiment create, as noted above, a generally rectangular shape. Normally, the length L is about 36 inches and the width W is about 12 inches. These dimensions are of course approximate and the roofing element A according to the present invention may be manufactured in other sizes if so desired.

The facing surface of the roofing element A is covered with a granular mineral over substantially the entire surface area. Such coatings are well known in the art and the present invention is not limited to any particular coating. Generally, a base of fibre batting or other inexpensive material is dipped or otherwise provided with a bituminous coating which is then covered with the mineral layer to yield a water resistant and weatherproof shingle.

As can be best seen in FIG. 1, the headlap portion 2 is provided with a granular mineral coating substantially darker than that making up the majority of the butt portion 4. The region of contact between the darkened area of headlap area 2 and the non-darkened portion of the butt portion 4 extends along a substantially straight line 14, running generally parallel to both the top edge 6 and the butt edge 8.

The butt portion 2 is also provided with a series of laterally adjacent simulated shingles 16, 18, 20, 22 and 24 extending between the leading edge 10 and the trailing edge 12. Each of the simulated shingles 16 through 24 are provided with edges 26, 28, 30, 32 and 34 respectively and each of which forms a portion of the overall length L of butt edge 8. Also forming part of the simulated shingles 16 through 24 are simulated keyslots 36, 38, 40, 42 and 44 respectively which extend from the butt edge 8 rearwardly towards the darkened headlap portion 2 and in contact therewith.

As can be appreciated from the drawing of FIG. 1, each of the simulated keyslots 36 through 44 are provided with a shading or coloration matching the darkened headlap portion 2. The simulated keyslots 36 through 44 are of equal width and form a continuous parallel series extending along the length of butt portion 4. This arrangement is such that the first keyslot 36 is spaced inwardly from the leading edge 10 of the roofing element A and the last keyslot 44 is positioned adjacent to the trailing edge 12. The keyslots have a width of about $\frac{3}{8}$ inch, plus or minus $\frac{1}{4}$ inch.

As best shown in FIG. 1, each of the simulated shingles 16 through 34 have a varying width w' with respect to any adjacent simulated shingle. This arrangement results in an overall butt edge 8 which is irregular or jagged in appearance. Thus, the shingle edge 26 of simulated shingle 16 and the shingle edge 28 of simulated shingle 18 intersect at a corner portion 46. This corner 46 results from the difference in width w' between the two simulated shingles. Additional corner portions 48, 50 and 52 are also positioned along the length of the butt edge 8 and formed in a similar manner.

As can be best seen in FIG. 1, the simulated keyslots 36, 38, 40 and 42 are positioned on the butt portion 4 at each of the corner portions 46 through 52 with a remaining simulated keyslot 44 positioned adjacent the trailing edge 12 of the roofing element A. Thus, each of the simulated shingles 16 through 24 are set off from each other by the disposition of the simulated keyslot 36 through 44 and the varying widths w' of each of the simulated shingles.

The dimensions of the simulated shingles 16 through 24 are such that at least two of the shingles; shingles 18 and 22, have their respective edge portions 28 and 32 extending beyond the edge portions 26, 30 and 34 of each of the adjacent shingles 16, 20 and 24. The edge portion 28 of shingle 18 extends about one-half inch beyond the edge portions 26 and 30 of adjacent shingles 16 and 20. The edge portion 32 of shingle 22 extends one-half inch beyond edge portion 30 of adjacent shingle 20 and one-quarter inch beyond the edge portion 34 of adjacent shingle 24 which is positioned adjacent the trailing edge 12.

As can be best seen in FIG. 1, the length of each of the individual simulated shingles 16 through 24 varies along the overall length L of the shingle A. The length for each individual shingle may extend from about five inches to about nine inches for each simulated shingle. In a preferred embodiment, the length of simulated shingle 16 is six inches while adjacent simulated shingle 18 is eight inches. The central simulated shingle 20 has a length of seven inches while adjacent simulated shingle 22 has a length of six inches. The remaining simulated shingle 24, which borders the trailing edge 12, has a length of about nine inches.

Figure 4:
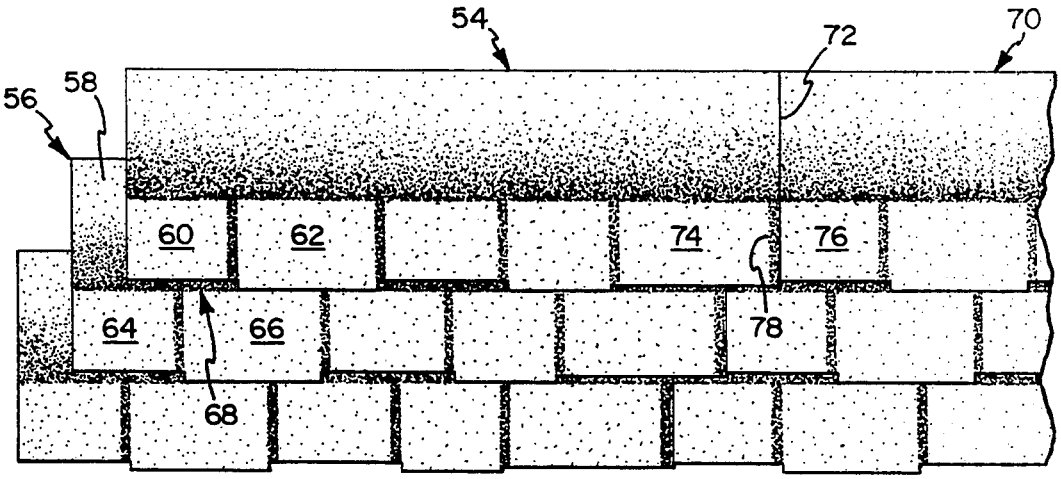
FIG. 4 shows an application of a plurality of covering elements shown in FIG. 1 arranged in an overlapping relation to create an overall roof covering.

Turning now to FIG. 4, the roofing element A shown in FIG. 1 is depicted in an overlapping relation with other identical elements or shingles to provide an overall roof covering. Roofing element 54 substantially identical to that shown in FIG. 1 can be seen in an overlapped position upon a second, identical roofing element 56. As is apparent, roofing element 54 overlies the majority of the headlap portion 58 of roofing element 56. Also, the roofing element 54 is overlapped onto the roofing element 56 in a staggered relation so that the individual simulated shingles 60 and 62 are staggered or off-set with respect to the identical shingles 64 and 66 of roofing element 56 on top of which they are positioned. An interrupted shadow line 68 is thereby created below simulated shingles 60 and 62 to produce an overlap effect of the simulated shingles 60, 62, 64 and 66 with respect to each other.

The trailing edge of roofing element 54 abuts against the leading edge of roofing element 70 at junction 72. As a result, simulated shingle 74 of roofing element 54 is positioned adjacent the first shingle 76 of roofing element 70 with simulated keyslot 78 setting off or separating each shingle with respect to each other. Also, the width of the end simulated shingle 74 is greater than the width of first simulated shingle 76 so that, when positioned in this abutting relation, the overall staggered relationship between each of the individual simulated shingles remains constant. This arrangement yields an overall roofing effect which is both more natural and representative of a genuine slate shingle arrangement.

Figure 2:
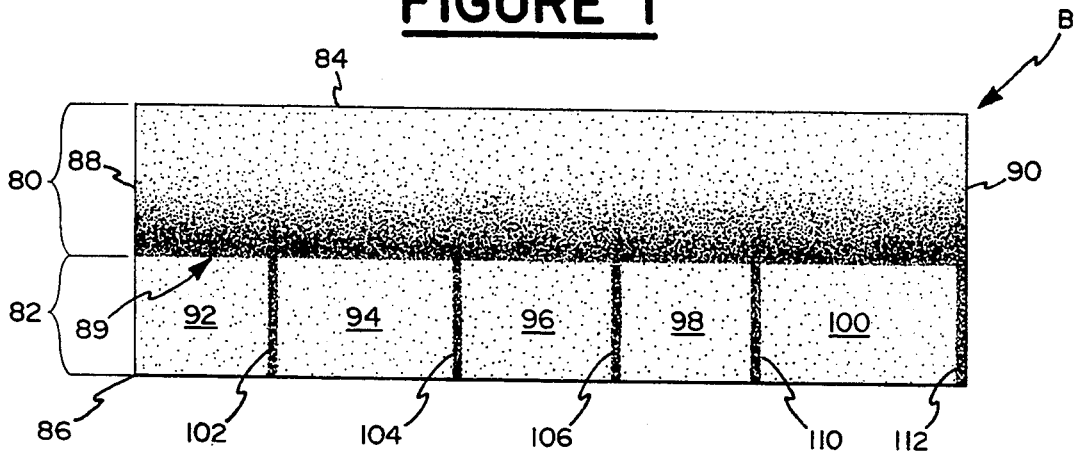
FIG. 2 is a plan view showing a different form of the covering element according to the present invention.

Turning now to FIG. 2, a different form of the roofing element according to the present invention is shown. As with the roofing element A shown in FIG. 1, roofing element B in FIG. 2 includes a headlap portion 80 and a butt portion 82. The overall shape of the shingle B is rectangular and bordered by a top edge 84, a bottom edge 86 a leading edge 88 and a trailing edge 90. The headlap portion 80 is darkened with respect to the butt portion 82 and a series of simulated shingles 92, 94, 96, 98 and 100 are disposed along butt portion 82.

Positioned between each of the simulated shingles 92 through 100 are simulated keyslots 102, 104, 106 and 110 with an end keyslot 112 positioned adjacent the trailing edge 90. Each of the keyslots has a width of about ⅜ inch, plus or minus one quarter inch. Where the darkened portion of headlap portion 80 and butt portion 82 meet, a shadow line 89 extends along a parallel line to the top edge 84 and butt edge 86. The keyslots are the same shading as the darkened portion of headlap portion 80 and are in contact therewith.

Figure 3:
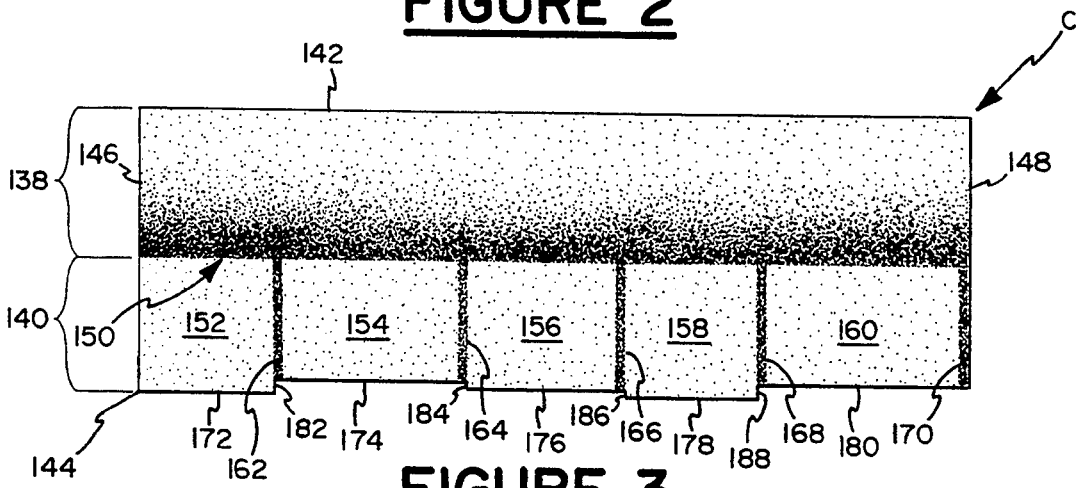
FIG. 3 shows a plan view of a different form of the covering element according to the present invention.

As with the roofing element A shown in FIG. 1, the roofing element B of FIG. 3 has substantially similar overall dimensions. Each of the simulated shingles 92 through 100 vary in their lengths from between about five inches to about nine inches. In a preferred embodiment, the lengths of the shingles are six inches for shingle 92, eight inches for shingle 94, seven inches for shingle 96, six inches for shingle 98 and nine inches for the remaining shingle 100 which borders the trailing edge 90.

The shingle shown in FIG. 2 does possess a butt edge 86 which is both uniform and straight throughout. Thus, each of the simulated shingles 92 through 100 has a width substantially equal in distance.

Figure 5:
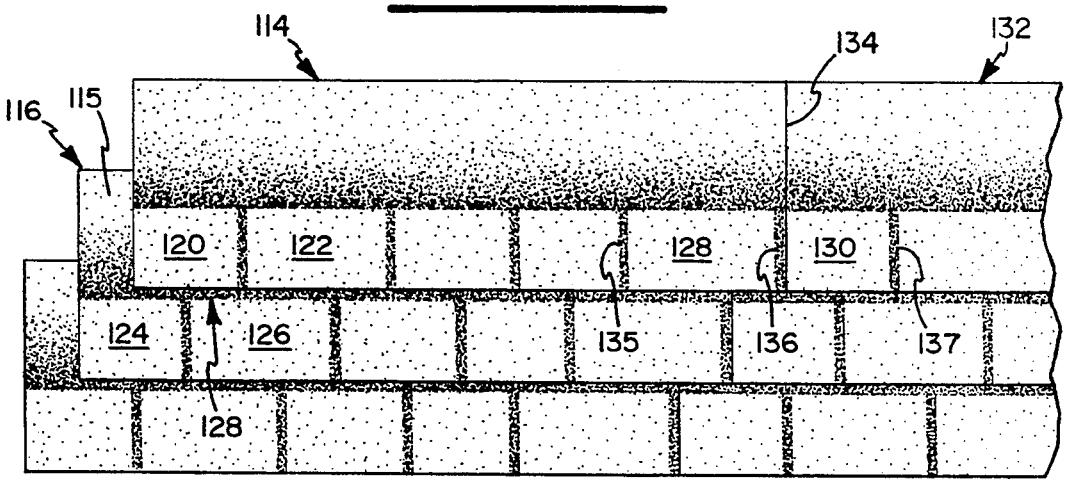
FIG. 5 shows an application of a plurality of covering elements shown in FIG. 2 and arranged in an overlapping relation to create an overall roof covering.

Turning now to FIG. 5, a plurality of roofing elements identical to that shown in FIG. 2 are arranged in an overlapping relation to create an overall roof covering. As with the overall roof covering shown in FIG. 4, individual roofing elements 114 and 116 are shown in an overlapping relation. The headlap portion 115 of the roofing element 116 is overlapped by roofing element 114 so that simulated shingles 120 and 122 are positioned above and offset from simulated shingles 124 and 126 of the roofing element 116.

Because of this overlapped relation, an uninterrupted shadow line 128 is exposed above simulated shingles 124 and 126 and below simulated shingles 120 and 122. The last simulated shingle 128 of roofing element 114 is positioned adjacent the first simulated shingle 130 of roofing element 132. Thus, the trailing edge of roofing element 114 and the leading edge of roofing element 132 abut at junction 134 and align therewith to provide a series of horizontally aligned simulated shingles which appear in a continuous fashion and are set-off from each other by vertical keyslots 135, 136 and 137.

Turning now to FIG. 3 yet a different form of the roofing element according to the present invention is shown whereby the roofing element C is provided with a headlap portion 138 and a butt portion 140 extending along the entire length of the roofing element C. The overall rectangular shape of roofing element C is bordered by a top edge 142 which runs along the upper edge of the headlap portion 138 and a butt edge 144 which runs along the lower edge of the butt portion 140. A leading edge 146 and trailing edge 148 extend between the top edge 142 and the butt edge 144 thereby completing the periphery of the entire roofing element C.

The headlap portion 138 is darkened along its surface with respect to the butt portion 140. Where the darkened and lightened portions meet, a shadow line 150 extends parallel to the top edge 142 and butt edge 144.

Simulated shingles 152, 154, 156, 158 and 160 are positioned in an adjacent relation within butt portion 140 and from the leading edge 146 to the trailing edge 148. As with the roofing elements depicted in FIGS. 1 and 2, simulated shingles 152 through 160 of FIG. 3 have lengths extending from between about five inches to about nine inches. In a preferred arrangement, simulated shingle 152 is six inches in length, shingle 154 is eight inches in length, shingle 156 is seven inches in length, shingle 158 is six inches in length and shingle 160 is nine inches in length. The net result of this arrangement is that no two adjacent simulated shingles are of an identical length.

Also forming part of the butt portion 140 are simulated vertical keyslots which serve to separate each of the simulated shingles 152 through 160. Simulated keyslot 162 is disposed between simulated shingle 152 and 154 while simulated keyslot 164 is positioned between simulated shingle 154 and 156. A third simulated keyslot 166 extends between simulated shingle 156 and 158 while a fourth simulated keyslot 168 extends between simulated shingles 158 and 160. A final keyslot 170 is disposed along the trailing edge 148 of the shingle C. The keyslots have a width of about ⅜ inch, plus or minus one quarter inch. As can be appreciated, each of the simulated keyslots are of a coloration which matches that of the headlap portion 138 and each extends continuously from the butt edge 144 along a vertical line to the shadow line 150.

The simulated shingles 152 through 160 are additionally set off with respect to each other by providing adjacent simulated shingles of unequal widths. For example, simulated shingle 152 includes an edge portion 172 forming a part of the overall butt edge 144 extends about one-half inch beyond the edge portion 174 of the adjacent simulated shingle 154. Simulated shingle 156 which is also adjacent to simulated shingle 154 has an edge portion 176 extending one-quarter inch beyond the edge portion 174 of simulated shingle 154. Simulated shingle 158 is provided with an edge portion 178 extending one-quarter inch beyond the edge 176 of adjacent shingle 156 but a full one-half inch beyond edge portion 180 of adjacent shingle 160.

The varying widths of each of the simulated shingles 152 through 160 serve to create a series of corners portions or edges where each of the various edge portions 172 through 180 come into mutual contact. Thus, corner portion 182 is disposed between simulated shingle edge portions 172 and 174. Corner portion 184 is disposed between simulated shingle edge portions 174 and 176. Corner portion 186 is disposed between simulated shingle edge portions 176 and 178 while corner portion 188 is disposed between simulated shingle edge portions 178 and 180. As can be appreciated, each of the simulated keyslots 162 through 168 are positioned and extend rearwardly in a vertical direction from each of the corner portions 182 through 188 respectively. The keyslots extend from shadow line 150 to the butt edge 144 and are in contact therewith.

Figure 6:
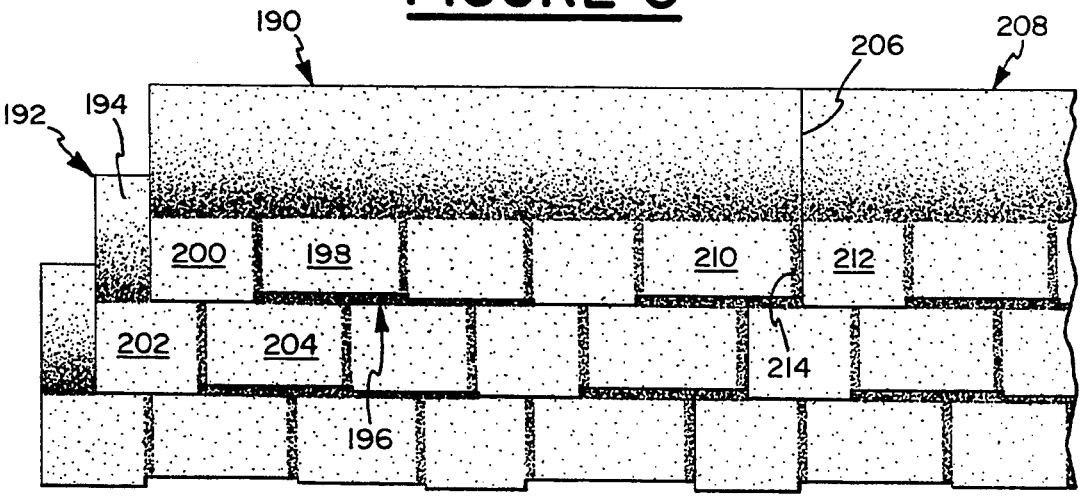
FIG. 6 shows an application of a plurality of shingles shown in FIG. 3 and arranged in an overlapping relation to form an overall roof covering.

Turning now to FIG. 6, a series of roofing elements identical to that shown in FIG. 3 are depicted in an overlapped relation thereby creating an overall roof covering. A roofing element 190 is shown overlying a second identical roofing element 192 so that substantially all of the headlap portion 194 of roofing element 192 is covered while leaving a partially exposed shadow line 196 between overlying simulated shingles 198, 200 and underlying simulated shingles 202 and 204.

The trailing edge of roofing element 190 abuts at junction 206 against the leading edge of roofing element 208. The net result of this arrangement is that shingle 210 of roofing element 190 is horizontally aligned with simulated shingle 212 of roofing element 208 with keyslot 214 extending therebetween. The overall effect of employing the shingles shown in FIGS. 3 and 6 is a roof covering yielding simulated shingles which are staggered with respect to each other and more natural in appearance.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

I claim:

1. A roof covering construction comprising in combination:

a) a plurality of generally rectangular roofing elements, b) each of said plurality of rectangular roofing elements comprising a main body bordered by top, butt, leading and trailing edges;

c) said leading and trailing edges extending between said top and said butt edges;

d) said main body including headlap and butt sections;

e) said headlap section being integral with said butt section;

f) said headlap section being defined from said butt section by a darkened area having a straight line bottom edge extending parallel to said top and butt edges;

g) at least a substantial portion of said headlap section being substantially darker than said butt section and gradually diminishing in darkness from said straight line bottom edge to said top edge;

h) said butt section providing a series of laterally adjacent simulated shingles extending from said leading edge to said trailing edge;

i) each of said simulated shingles having an edge forming a portion of said butt edge and each having a simulated keyslot extending rearwardly toward said headlap section and contacting and merging with said straight line bottom edge;

j) said simulated keyslots being uniform in darkness throughout their length and similar in darkness to said straight line bottom edge;

k) said butt edge having portions between said simulated keyslots substantially lighter than the darkness of said keyslots;

l) said simulated shingles being of uniform lightness from said butt edge to said straight line bottom edge except for said simulated keyslots;

m) said simulated keyslots being equal in width and forming a parallel series along said butt section in which said first of said simulated keyslots is spaced inwardly from said leading edge and the last of said simulated keyslots is positioned on and adjacent to said trailing edge;

n) said simulated series of shingles including at least one of said series of simulated shingle having an edge extending downwardly below the edge of an adjacent shingle;

o) said simulate keyslots extending only to the edge of said adjacent shingles; and p) said plurality of roofing elements being aligned on and affixed to a roof to be covered in an overlapping relation such that the said headlap portion of an underlying element is substantially covered by said butt section of an overlying element and the first of said simulated keyslots adjacent said leading edge of said underlying elements is collinear along a vertical plane with said leading edge of a second overlying element positioned on said first overlying element so that when said plurality of aligned roofing elements are viewed from a distance, they simulate an authentic shingled roof.

2. A generally rectangular roofing element adapted to be positioned with other similar elements in an overlapping relation to provide a simulated slate roofing covering comprising:

a) a main body bordered by top, butt, leading and trailing edges;

b) said leading and trailing edges extending between said top and said butt edges;

c) said main body including headlap and butt sections;

d) said headlap section being integral with said butt sections;

e) said headlap section being defined from said butt section by a darkened area having a straight line bottom edge extending parallel to said top and butt edges;

f) at least a substantial portion of said headlap section being substantially darker than said butt section and generally diminishing in darkness from said straight line bottom edge to said top edge;

g) said butt section providing a series of laterally adjacent simulated shingles extending from said leading edge to said trailing edge;

h) each of said simulated shingles having an edge forming a portion of said butt edge and each having a simulated keyslot extending rearwardly towards said headlap section and contacting and merging with said straight line bottom edge;

i) said simulated keyslots being uniform in darkness throughout their lengths and similar in darkness to said straight line bottom edge;

j) said butt edge having positions between said simulated keyslots substantially lighter than the darkness of said keyslots;

k) said simulated shingles being of uniform lightness from said butt edge to said straight line bottom edge except from said simulated keyslots; and l) said simulated key slots being equal in width and forming a parallel series along said butt section in which said first of said simulated keyslots is spaced inwardly from said leading edge and the last of said simulated keyslots is positioned on and adjacent to said trailing edge;

m) said simulated series of shingles including at least one of said series of simulated shingle having an edge extending downwardly below the edge of an adjacent shingle;

n) said simulated keyslots extending only to the edge of said adjacent shingles.

3. A roofing element as in claim 2 and wherein:

a) said series of adjacent simulated shingles comprising five shingles including two pair of shingles each pair of which having a different width and one of said five shingles has an intermediate width and is positioned between said two pair of said five shingles.

4. A roofing element as in claim 2 and wherein:

a) said simulated keyslot and said darkened portion of said headlap portion being an applied coating of roofing material.

5. A roofing element as in claim 2 and wherein:

a) said non-darkened butt portion being an applied coating of roofing material.

6. A roofing element as in claim 2 and wherein:

a) said shingles comprising five separate shingles extending between said leading edge to said trailing edge and in lengths of six inches, eight inches, seven inches, six inches and nine inches respectively.

7. A roofing element as in claim 2 and wherein:

a) said at least two shingles extend one half inch beyond the edge portion of at least one of said adjacent shingles.

* * * * *